US006244772B1

(12) United States Patent
Ruchonnet

(10) Patent No.: US 6,244,772 B1
(45) Date of Patent: Jun. 12, 2001

(54) WRITING IMPLEMENT, IN PARTICULAR A PEN

(75) Inventor: Jean-Francois Ruchonnet, Vessy (CH)

(73) Assignee: Chopard International S.A., Fribourg (CH)

( * ) Notice: Subject to any disclaimer, the term of this patent is extended or adjusted under 35 U.S.C. 154(b) by 0 days.

(21) Appl. No.: 09/319,179

(22) PCT Filed: Dec. 22, 1997

(86) PCT No.: PCT/IB97/01593

§ 371 Date: Dec. 6, 1999

§ 102(e) Date: Dec. 6, 1999

(87) PCT Pub. No.: WO98/28156

PCT Pub. Date: Jul. 2, 1998

(30) Foreign Application Priority Data

Dec. 23, 1996 (FR) ..... 96/16157

(51) Int. Cl.[7] ..... B43K 79/00
(52) U.S. Cl. ..... 401/195; 401/52
(58) Field of Search ..... 401/175, 52, 213, 401/243, 202

(56) References Cited

U.S. PATENT DOCUMENTS

| | | | | |
|---|---|---|---|---|
| 3,343,292 | * | 9/1967 | Jorgensen | 401/195 |
| 3,639,069 | * | 2/1972 | Gordon | 401/195 |
| 5,007,756 | * | 4/1991 | Wey | 401/195 |
| 5,328,172 | * | 7/1994 | Jagiella | 401/195 |

* cited by examiner

*Primary Examiner*—David J. Walczak
(74) *Attorney, Agent, or Firm*—Clifford W. Browning; Woodard, Emhardt, Naughton, Moriarty & McNett

(57) ABSTRACT

A writing instrument, notably a pen, comprising a body (1*a*, 1*b*) characterized in that this body or a fitted piece comprises at least one housing (6) having a transparent outer wall (7). The height of this housing (6) between its bottom and said transparent outer wall (7) is substantially constant, at least one movable decorative element (9) such as a diamond being movably mounted inside said housing (6), at least one of the dimensions of the movable element perpendicular to said height being substantially less than the corresponding dimension of the housing (6). This movable decorative element (9) is mounted in a support comprising two guide surfaces (10*a*, 10*b*) adjacent to the said bottom (6*a*) and to said transparent wall (7) respectively, these surfaces allowing random movement in translation and in rotation of said decorative element (9) about itself inside said housing (6).

9 Claims, 1 Drawing Sheet

WRITING IMPLEMENT, IN PARTICULAR A PEN

The present invention relates to a writing instrument, notably a pen having a body.

There are various ways of imparting an original and pleasing appearance to a pen's body, notably of a luxury pen, to differentiate it from an ordinary pen. An original appearance can result from the materials used, the shape, surface treatments, decorative effects, or from added elements.

In decorative research relating to pens, EP-A1-0 469 388 has already proposed a writing instrument having at its end a mobile part that moves in response to actuation of an actuating member of the pen, moving apart like the petals of a flower to uncover a fixed decorative element lodged thereunder.

There have been many other proposals for giving a pen a special decorative effect. FR-A-1 309 159 or U.S. Pat. No. 4,658,523 can be cited. However, one has to conclude that the functional cylindrical shape of this instrument considerably limits creators' freedom such that in this area there are not many original new designs, or the proposals are extravagant. For example, those in the above-indicated document do not correspond to expectations as regards luxury watches, whose purchasers would only find acceptable such design variations as would reflect good taste.

It has already been proposed, in U.S. Pat. No. 4,217,712 which corresponds to the precharacterizing part of claim 1, to include a movable decorative element inside a housing provided at the end of a pen. However, to achieve this objective, it was necessary to deviate from the ergonomical shape of the pen which is generally cylindrical, sometimes with an annular concave gripping zone. This document indeed specifies that by making the pen body with a conical shape to the pen body it is possible to increase the area of its end so as to incorporate a decorative element in a housing closed by a transparent wall. Moreover, the decorative element is formed by a ball which is entirely free to move in the housing. Clearly, such a writing instrument with a conical body is an object of fancy and has nothing to do with luxury pens which first and foremost must meet up to ergonomical requirements, which obviously is not so for the conical shape.

It has already been proposed in FR 704 214 and in GB-2 004 096 to combine a watch and a pen into a single item by securing a miniature watch at the end of a pen cap, or onto an enlarged end of a pen. This combination of two different objects on a common support is essentially for utilitarian purposes.

A watch having a housing inside its case, wherein a decorative element is movable parallel to itself has been described in CH 609 517.

From the above, it can be seen that a movable object has already been associated with a housing provided in an end of a pen, whereby it is visible through a transparent wall of the housing which forms the large base of a conical body. It has been proposed to miniaturize a watch so that it can be fitted on the end of a pen, and a housing has been provided inside a watch case in which decorative elements are movable parallel to themselves.

According on the one hand to the above-mentioned U.S. Pat. No. 4,217,712, the shape of the pen has been modified to fit a mobile decorative element. On the other hand, a watch has been miniaturized to fit it on the end of a pen cap.

In the above-mentioned CH 609 517 which concerns a watch, a space was left corresponding to the dial or surrounding the dial, in which a housing was provided to receive decorative movable elements. Clearly, the teaching of CH 609 517 cannot be applied directly to a pen whose dimensions, in particular the diameter of a cylindrical body, are limited by ergonomic considerations. This is not so far a watch, at least to the same degree. Taking all this into account, it is neither possible to deviate from the cylindrical shape of a pen without adversely affecting its aesthetic appearance and its function, nor can the diameter of its cylindrical body be varied except within specified small limits.

Taking into account these dimensional constraints, it would be conceivable to set a diamond in an end of a pen's body to provide a luxurious appearance, but without providing any special effect.

An aim of the present invention is to produce an original decorative effect from the glittering of a movable element applied to a writing instrument which is embodied in the shape of a fountain pen, while producing a new aspect relative to conventional pens.

For this purpose, this invention concerns a writing instrument, notably a pen, comprising a body having a housing at least at one of its ends, the housing having a transparent outer wall, the height of this housing between its bottom and said transparent outer wall being substantially constant, at least one movable decorative element being movably mounted inside said housing, at least one of the dimensions of the movable element perpendicular to said height being substantially less than the corresponding dimension of the housing.

According to the invention, this writing instrument is characterized in that said decorative element comprises a lateral surface extending in the direction of the height of said housing, one end of this decorative element being shaped so that it contacts the adjacent wall of the housing only in a zone situated in the centre thereof to form a first guide means, whereas the other end is shaped to come into contact with the adjacent wall of said housing by the edge of its lateral surface to form a second guide means. A small play is left between the height of said housing and the axial distance between said height and the guide means, such that movement of this decorative element inside said housing is limited to a random movement in translation and/or in rotation about said central contact zone.

The proposed solution has the advantage that it can perfectly be adapted to a fountain pen and integrate into its shape. Specifically, it enables the housing to be provided in a separate part that is screwed to the end of a cap, most expensive pens already having such a screwed part.

The use of a precious stone, for instance a diamond, as movable decorative element enables the luxurious aspect of a quality pen to be enhanced while procuring an original and unexpected appearance resulting notably from the glittering of this precious stone as it moves at random in translation and/or rotates about itself.

The accompanying drawing shows, schematically and by way of example, an embodiment of a fountain pen according to the present invention.

Figures 1, 2, 3:
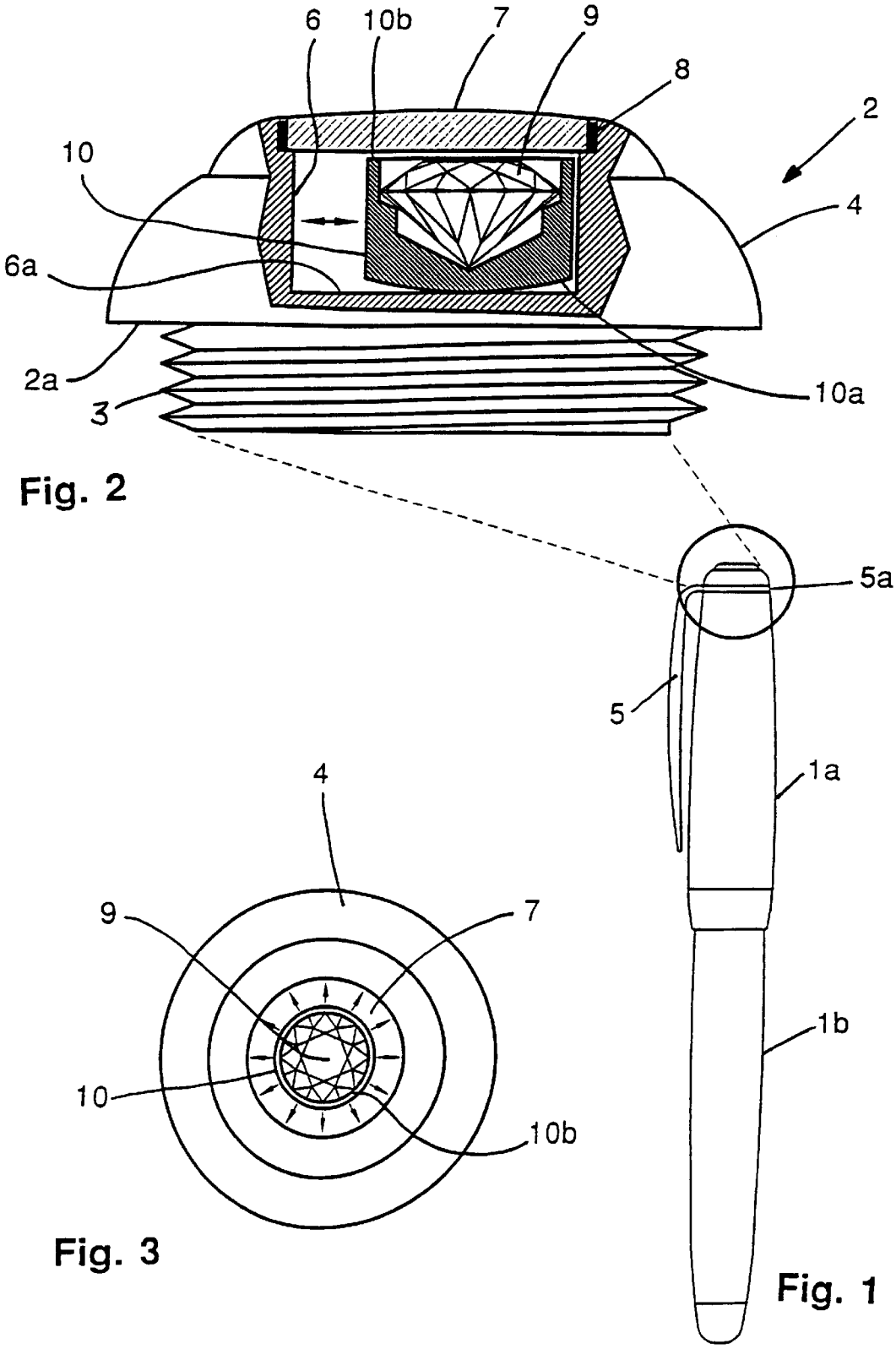
FIG. 1 is an elevational view of this embodiment.
FIG. 2 is an enlarged view of part of the end of FIG. 1 with a cut-away part shown in cross-section.
FIG. 3 is a plan view of FIG. 2, with the movable decorative element located centrally.

The pen shown in FIG. 1 has a body in two parts 1*a*,1*b* corresponding respectively to the cap and main body of the pen, and which are screwed or clipped together in the usual way.

A part 2, having a threaded cylindrical section 3 (FIG. 2) and an end piece 4 forming the pen's end, is screwed on the cap opposite its central recess receiving the pen's main body 1*b*. The shoulder 2*a* between the threaded section 3 and the cap's end-part 4 serves to secure a ring 5*a* integral with a clip 5 designed for attachment of the pen in particular to the edge of a jacket pocket.

The part 4 comprises a housing 6, which in this example is cylindrical, centered on the axis of the generally cylindrical body 1*a*,1*b* whose diameter at the ends is no greater than the diameter of the main body which, in this example, is slightly curved. This housing 6 has an opening coinciding with its end face adjacent to the end of part 4. This opening is closed by a flat sapphire glass 7 having a dished outer face. This glass is secured to the edge of this opening by a sealing ring 8 parallel to the bottom 6*a* of housing 6.

As can be seen on FIG. 2, the internal faces of the glass 7 and of the bottom 6*a* are flat and parallel so that the housing 6 has a constant height. This housing 6 encloses a movable decorative element which, in this example, is a diamond 9 secured in a support 10, for example of gold of another precious metal. This support 10 is designed to hold the diamond in a given position and to allow it to move parallel to itself inside the housing 6, and to turn around itself. For this, the support 10 in this example is shaped as an internally hollow cylinder that receives the diamond 9. The bottom 10*a* of this cylinder, adjacent to the smooth bottom 6*a* of the housing 6 constitutes a convex first guide surface to reduce friction and to facilitate rotation of the diamond about itself. The lateral wall of support 10 surrounds the diamond 9 and slightly extends beyond the level of the upper face of the diamond to prevent contact between the diamond 9 and the sapphire glass 7.

As can be seen on FIG. 2, a slight play is provided between the edge 10*b* of the support 10 and the glass 7, leaving the support 10 free to move in translation and to rotate about itself, without jumping. The edge 10*b* of this lateral wall adjacent the sapphire glass 7 constitutes a second guide-surface. The two guide surfaces ensure movement of the support and hence of the movable decorative element 9 in random translational movement inside the housing 6, as illustrated by the arrows in FIG. 3. This random translational movement of the decorative element occurs together with a rotation about its axis of revolution, which increases the diamond's glittering effect. As a variation, the glass 7 could have a flat external face instead of being curved as shown in FIG. 2.

A watch fitted with such movable decorative elements 9 and supports 10 is already described in CH-609 517. These movable decorative elements are mounted in a housing provided between the watch glass and a second underlying transparent wall, parallel to the glass. Thanks to the guide means associated with the support and cooperating with these two parallel transparent surfaces, the movable decorative element visible through the watch glass can move in translation and rotate at random. The same principle has been applied to luxury jewelry items, notably pendants and rings, as well as to luxury spectacle frames as jewelry items, also comprising movable decorative elements between two glasses.

A fountain pen, because of the cylindrical shape of its body and because the body neither has a housing nor a glass, does not allow the incorporation of such a movable decorative element without any modification.

Whereas the movable decorative element has been known already for twenty years for watches, it has to be observed that no modification of a decorative element of this type has yet been proposed to adapt it to pens, despite the great success in the field of luxury watches.

It is possible to envisage other shapes for the movable decorative elements or their mounting support than those illustrated. It is for instance possible to have a heart-shaped, half-moon shaped, or ball-shaped element, carrying one or more diamonds to cite but a few possible variations.

The internal surface of the glass 7 and the smooth surface of the bottom of housing 6 are parallel in order to ensure a translational and rotational movement of the movable decorative element, without wear.

Although a housing has been shown that opens at the end of the pen's body, it would also be possible to envisage an annular housing having a transparent window constituted by a transparent portion of the lateral wall of the body 1*a* or 1*b*. In this example, one or more movable decorative elements 9,10 could be placed in this annular housing centered as the body's longitudinal axis, these decorative elements being free to turn about the longitudinal axis of the body 1*a*,1*b*.

As a variation, it would also be possible to secure the piece 2 to the other end of the pen's body 1*b*, or provide a piece 2 at each end.

Screwing this piece 2 to an end of the body may be provided by means of a sleeve (not shown) of a wear-resistant material, for example of metal. This sleeve could itself be screwed into a suitably-dimensional recess.

In a variation, the housing 6 for containing the diamond 9 and its support 10 could be directly made in the pen's body 1*a*, in particular by a machining operation.

It would also be possible to secure the piece 2 by means of three screws, either in the cap 1*a* through three bores through the bottom 6*a* of housing 6, or in the bottom 6 from inside the cap 1*a*. The piece 2 could also be stuck on the cap 1*a* by an adhesive, or in a housing provided therein.

What is claimed is:

1. A writing instrument, comprising a body (1*a*, 1*b*) having a longitudinal axis and a housing (6) at least at one of its ends, the housing having a transparent outer wall (7), the height of this housing (6) between its bottom and said transparent outer wall (7) being substantially constant, at least one movable decorative element (9, 10) being movably mounted inside said housing (6), at least one of the dimensions of the movable element perpendicular to said height being substantially less than a corresponding dimension of the housing, characterized in that said decorative element (9, 10) comprises a lateral surface extending in the direction of the height of said housing (6), one end (10*a*) of this decorative element being shaped so that it contacts an adjacent wall of the housing (6) only in a zone situated in the center thereof to form a first guide means, whereas the other end is shaped to come into contact with an adjacent wall of said housing (6) by an edge (10*b*) of its lateral surface to form a second guide means, a small play being left between said housing (6) and the guide means, such that movement of this decorative element (9, 10) inside said housing is limited to a random movement in translation and in rotation about said central contact zone.

2. A writing instrument according to claim 1, characterized in that said housing is centered on the longitudinal axis of said body (1*a*, 1*b*).

3. A writing instrument according to claim 1, characterized in that said transparent wall (7) forms one end along the longitudinal axis of said body (1*a*, 1*b*).

4. A writing instrument according to claim 1, characterized in that said transparent wall is constituted by an axial part of said body (1*a*, 1*b*).

5. A writing instrument according to claim 1, characterized in that said decorative element (9) is a precious stone mounted in a support (10).

6. A writing instrument according to claim 5, characterized in that said support (10) has a convex surface (10*a*) constituting a guide surface acting against the bottom of said housing (6).

7. A writing instrument according to claim 6, characterized in that said housing (6) is provided in a part (2) fitted on said body (1*a*, 1*b*).

8. A writing instrument according to claim 7, characterized in that said fitted part (2) comprises a threaded cylindrical securing part (3), threadably engaged in a corresponding thread inside a closure cap (1*a*) of the writing instrument, a base of the cylindrical part (3) having a shoulder (2*a*), an annular part (5*a*) of a securing clip (5) of the writing instrument being gripped between this shoulder (2*a*) and the end of the pen.

9. A writing instrument, comprising a body (1*a*, 1*b*) having a longitudinal axis and a housing (6) at least at one of its ends, the housing having a transparent outer wall (7), the height of this housing (6) between its bottom and said transparent outer wall (7) being substantially constant, at least one movable decorative element (9, 10) being movably mounted inside said housing (6), at least one of the dimensions of the movable element perpendicular to said height being substantially less than a corresponding dimension of the housing, characterized in that said decorative element (9, 10) comprises a lateral surface extending in the direction of the height of said housing (6), one end (10*a*) of this decorative element being shaped so that it contacts an adjacent wall of the housing (6) only in a zone situated in the center thereof to form a first guide means, whereas the other end is shaped to come into contact with an adjacent wall of said housing (6) by an edge (10*b*) of its lateral surface to form a second guide means, a small play being left between said housing (6) and the guide means, such that movement of this decorative element (9, 10) inside said housing is limited to a random movement in translation and in rotation about said central contact zone and means for removably joining the housing to the body.

* * * * *